US010986881B2

(12) United States Patent
Stanton et al.

(10) Patent No.: US 10,986,881 B2
(45) Date of Patent: Apr. 27, 2021

(54) BRASSIERE WITH INFLATABLE BLADDER

(71) Applicant: Sheffield Hallam University, South Yorkshire (GB)

(72) Inventors: Andrew Lee Stanton, South Yorkshire (GB); Alexander H. Reed, South Yorkshire (GB); Heidi Probst, North Yorkshire (GB)

(73) Assignee: Sheffield Hallam University, Sheffield (GB)

( * ) Notice: Subject to any disclaimer, the term of this patent is extended or adjusted under 35 U.S.C. 154(b) by 124 days.

(21) Appl. No.: 16/312,646

(22) PCT Filed: Jun. 20, 2017

(86) PCT No.: PCT/GB2017/051803
§ 371 (c)(1),
(2) Date: Dec. 21, 2018

(87) PCT Pub. No.: WO2017/220997
PCT Pub. Date: Dec. 28, 2017

(65) Prior Publication Data

US 2019/0328050 A1 Oct. 31, 2019

(30) Foreign Application Priority Data

Jun. 21, 2016 (GB) ..... 1610811

(51) Int. Cl.
*A41C 3/10* (2006.01)
*A41C 3/00* (2006.01)

(52) U.S. Cl.
CPC ..... *A41C 3/105* (2013.01); *A41C 3/0064* (2013.01)

(58) Field of Classification Search
CPC ..... A61N 2005/1097
See application file for complete search history.

(56) References Cited

U.S. PATENT DOCUMENTS 990,279 A * 4/1911 Mayer ..... A41C 3/105 450/38
2,485,571 A * 10/1949 Cousins ..... A41C 3/02 450/46
2,741,769 A * 4/1956 White ..... G01L 3/22 450/38
2,864,372 A * 12/1958 Buckley ..... A41C 3/10 450/57

(Continued)

FOREIGN PATENT DOCUMENTS

CN 201718489 U 1/2011

OTHER PUBLICATIONS

International Search Report for WO Application No. PCT/GB2017/051803 dated Oct. 16, 2017, 6 pages.

(Continued)

*Primary Examiner* — Jocelyn Bravo
(74) *Attorney, Agent, or Firm* — Klarquist Sparkman, LLP

(57) ABSTRACT

Disclosed is a brassiere having breast cups configured with inflatable bladders specifically positioned and configured to manipulate the breast tissue of a target breast into a lifted position whilst simultaneously displacing laterally sideways/outward and downward a contra-lateral breast. The brassiere is configured to lift the target breast away from the chest wall and to stabilise the breast so as to increase treatment accuracy and reduce radiation dosage to high risk organs such as the heart and lung. The brassiere according to the subject invention is advantageous to be worn by women for the treatment of either the left or right breast whilst providing modesty during treatment delivery.

15 Claims, 5 Drawing Sheets

(56) References Cited

U.S. PATENT DOCUMENTS 2,899,961 A * 8/1959 Faron ..... A41C 3/10 450/41
3,934,274 A * 1/1976 Hartley, Jr. ..... A61F 2/12 623/8
4,263,682 A * 4/1981 Bejarano ..... A61F 2/12 623/8
4,969,898 A * 11/1990 Calogero ..... A61F 2/0059 623/7
5,347,656 A * 9/1994 Fabritz ..... A41C 3/105 2/67
5,697,974 A * 12/1997 Wang ..... A61F 2/52 623/7
5,782,671 A * 7/1998 Suen ..... A41C 3/10 2/267
5,800,245 A * 9/1998 Barbe-Vicuna ..... A41C 3/0064 2/267
5,823,852 A * 10/1998 Chu ..... A41C 3/105 450/38
6,015,332 A * 1/2000 Lee ..... A41C 3/144 450/38
6,080,037 A * 6/2000 Lee ..... A41C 3/105 2/67
6,165,045 A * 12/2000 Miller ..... A41C 3/0057 450/1
6,241,575 B1 * 6/2001 Shailer ..... A41C 3/105 2/69
6,302,760 B1 * 10/2001 Dai ..... A41C 3/105 450/38
6,319,091 B1 * 11/2001 Kilbride ..... A41C 3/0028 450/1
6,354,906 B1 * 3/2002 Liu ..... A41C 3/105 2/267
6,368,179 B1 * 4/2002 Kang ..... A41C 3/144 450/38
6,394,879 B1 * 5/2002 Paige ..... A41C 3/0064 450/1
6,461,221 B1 * 10/2002 Stilwell ..... A41C 3/0007 450/38
6,755,861 B2 * 6/2004 Nakao ..... A61F 2/12 623/7
6,796,875 B1 * 9/2004 Placik ..... A41C 3/0092 450/1
6,811,463 B2 * 11/2004 Martz ..... A41C 3/144 2/267
7,201,630 B2 * 4/2007 Cope ..... A41C 3/10 450/38
7,871,305 B2 * 1/2011 Cohen ..... A41C 3/10 450/57
7,879,091 B1 * 2/2011 Martin ..... A61F 2/52 623/7
8,216,021 B1 * 7/2012 MacKinnon ..... A41C 3/144 450/54
8,568,196 B2 * 10/2013 Haworth ..... A41C 3/0021 450/60
8,641,475 B1 * 2/2014 Hung-Ming ..... A41C 3/10 450/38
8,727,830 B2 * 5/2014 Fleeton ..... A41C 3/105 450/38
8,801,495 B1 * 8/2014 Guindon ..... A41C 3/105 450/36
8,900,032 B2 * 12/2014 Punsal ..... A41C 3/122 450/31
9,301,559 B2 * 4/2016 McQueer ..... A41D 13/0017
9,468,236 B1 * 10/2016 Sherry ..... A41C 3/105
9,470,411 B1 * 10/2016 Ramsey ..... A41B 9/00
10,582,730 B2 * 3/2020 Braverman ..... A41C 3/06
2002/0022432 A1 * 2/2002 Magrone ..... A41C 3/0014 450/41
2003/0232571 A1 * 12/2003 Weinerth ..... A41C 5/00 450/41
2004/0058618 A1 * 3/2004 Yang ..... A41C 3/0071 450/38
2007/0049163 A1 * 3/2007 Lin ..... A41C 3/10 450/54
2007/0123145 A1 * 5/2007 Chang ..... A41C 3/105 450/1
2008/0198578 A1 * 8/2008 Finn ..... F21V 33/0008 362/103
2008/0248718 A1 * 10/2008 Henke ..... A41C 3/04 450/38
2009/0098803 A1 * 4/2009 Reinisch ..... A41C 3/0014 450/39
2009/0233524 A1 * 9/2009 Cohen ..... A41C 5/005 450/56
2009/0247047 A1 * 10/2009 Avalos-Dessner ..... A41C 3/144 450/52
2009/0265831 A1 * 10/2009 Hendrickson ..... A41D 1/215 2/104
2009/0318058 A1 * 12/2009 Chen ..... F16K 15/147 450/38
2010/0022163 A1 * 1/2010 Widell ..... A41C 3/10 450/39
2010/0041313 A1 * 2/2010 Castellano ..... A41C 3/144 450/39
2010/0068973 A1 * 3/2010 Tseng ..... A41C 3/105 450/55
2010/0273395 A1 * 10/2010 Castellano ..... A41C 3/144 450/39
2010/0311307 A1 * 12/2010 Haworth ..... A41C 3/0021 450/57
2011/0065358 A1 * 3/2011 Fleeton ..... A41C 3/105 450/38
2011/0104985 A1 * 5/2011 Linder ..... A41C 3/0057 450/58
2012/0045967 A1 * 2/2012 Punsal ..... A41C 3/0057 450/82
2012/0122370 A1 * 5/2012 Heath ..... A41C 3/0057 450/80
2012/0208435 A1 * 8/2012 Haworth ..... A41C 3/0021 450/86
2013/0012100 A1 * 1/2013 Chen ..... A41C 3/105 450/38
2013/0065485 A1 * 3/2013 Goodwin ..... A41C 3/10 450/41
2013/0260639 A1 * 10/2013 Lin ..... A41C 3/105 450/38
2013/0309942 A1 * 11/2013 Sobah-Wilhelm ..... A41C 3/146 450/38
2014/0154947 A1 * 6/2014 Braverman ..... A41C 3/10 450/41
2015/0044943 A1 * 2/2015 Marshall ..... A41C 3/005 450/93
2015/0118936 A1 * 4/2015 Schlueter ..... A41C 3/12 450/1
2015/0351465 A1 * 12/2015 Duraku ..... A41C 3/105 450/38
2016/0029706 A1 * 2/2016 Braverman ..... A41C 3/06 450/55
2016/0151211 A1 * 6/2016 Biddlestone ..... A41C 3/148 602/43
2016/0286879 A1 * 10/2016 Farmer ..... A41D 13/012
2017/0156413 A1 * 6/2017 Braverman ..... A41C 3/0007
2017/0231291 A1 * 8/2017 Lima ..... A41C 3/0028 450/38
2018/0368495 A1 * 12/2018 Simmons ..... A61B 5/04085
2019/0240109 A1 * 8/2019 Barkay ..... A41C 3/105

OTHER PUBLICATIONS

English language abstract and machine translation for CN201718489 (U) extracted from http://worldwide.espacenet.com database on Dec. 11, 2018, 9 pages.

* cited by examiner

A - A

BRASSIERE WITH INFLATABLE BLADDER

CROSS-REFERENCE TO RELATED APPLICATIONS

This application is the National Stage of International Patent Application No. PCT/GB2017/051803, filed on 20 Jun. 2017, which claims priority to Great Britain Patent Application No. 1610811.0, filed on 21 Jun. 2016, the contents of which are incorporated herein by reference.

FIELD OF INVENTION

The present invention relates to a brassiere and in particular, although not exclusively to a brassiere having inflatable bladders to adjust a position of each breast suitable for radiotherapy and diagnostic applications.

BACKGROUND ART

Breast cancer affects a substantial proportion of the population with over 1.5 million diagnosed globally in recent years. For many of these women the primary treatment is local excision (LE) followed by external beam radiotherapy to the whole breast. Traditionally this has been given using basic tangential radiotherapy beams. New technology employing complex approaches such as 3D conformal and Intensity Modulated Radiotherapy (IMRT) provide the opportunity to spare sensitive structures that lie close to the breast. However, such techniques require greater accuracy in patient alignment. Set up inaccuracies (anterior-posterior and superior-inferior systematic displacements) have dosimetric consequences that vary depending on breast gradient, standard or IMRT based techniques and magnitude of error.

Most radiotherapy centres rely on the use of permanent tattoos marked on the patient and use laser alignment systems. However, accuracy using this approach can be problematic and the use of permanent tattoos is of concern to many patients. In addition, women with large (above a D bra cup size) or pendulous breasts can be difficult to position. Specifically, overhang of the breast inferiorly produces an effect that leads to an increased skin dose in the lower part of the breast and on the chest wall underneath the tissue overhang.

The long-term effects of incidental cardiac irradiation during breast radiotherapy have been assessed and studies have indicated that while modern radiotherapy techniques do not increase mortality from cardiac irradiation, the impact of cardiac morbidity on breast cancer survivors is a concern. In order to reduce the dose to the heart many centres are employing cardiac avoidance techniques including voluntary deep inspiration breath hold (vDIBH) which has been shown to reduce mean heart dose by approximately 50%. However, using vDIBH techniques adds further opportunity for patient movement during the beam on time and requires imaging (adding additional radiation dose to the patient) to ensure accuracy especially in the caudo-cephalic direction where mean systematic error in heart position of 0.5 cm have been reported.

Additionally, clinical trials testing partial organ techniques compared with whole breast irradiation (eg IMPORT low trial) in cases where there is low risk of tumour recurrence are starting to present their results. The principle of partial breast irradiation is to spare sensitive tissues by reducing the volume of breast tissue irradiated. However, partial organ techniques require accurate positioning if favourable cosmetic outcomes and local control are to be achieved. Many centres are employing image-guided radiotherapy (IGRT) as a way of confirming radiotherapy field placement prior to treatment exposure. However IGRT incorporates kilovoltage imaging that increases the patient total body radiation dose received and for younger women there is concern that the life time additional risk from this extra exposure to the contra-lateral breast could increase the likelihood of a second cancer.

Additionally, in the majority of radiotherapy centres worldwide women lie for breast irradiation, bare from the waist upwards, with up to four potentially male therapy radiographers adjusting and manipulating their thorax and breast in preparation for treatment.

A number of attempts have been made to support the breast for radiotherapy treatment and examples are described in U.S. Pat. Nos. 8,753,171; 8,814,774; 5,769,779; US 2013/0316616; and WO 2010/078048. However, existing breast manipulation garments are not optimised to stabilise the breast whilst manipulating the breast tissue into a position that optimises the radiotherapy treatment or diagnostic assessment whilst minimising radiation exposure to the contra-lateral breast. Accordingly, there is a need for a breast immobilisation and positioning device that addresses these problems.

SUMMARY OF THE INVENTION

It is an objective of the present invention to provide a breast immobilisation and positioning device configured to lift a breast for a treatment or diagnostic investigation whilst reducing the radiation dose to primary organs such as the heart and lung. It is a further specific objective to provide a wearable garment configured to support a first breast to undergo treatment or diagnosis and to minimise, as far as possible radiation exposure to a contra-lateral breast. It is a yet further specific objective to minimise undesirable compression, folding or wrinkling of the breast tissue whilst the breast is lifted upwardly and away from the thoracic cage [HR1] for treatment or diagnosis.

It is yet a further objective to provide a garment that may be initially calibrated so as to be tailored to the body and breast shape (including the breast type, position etc) that may be worn conveniently as an undergarment and is capable of remaining in position during radiotherapy and diagnostic sessions. It is a further specific objective to provide a garment capable of being initially positionally adjustable to obtain a desired positioning of the breasts and then to provide positional repeatability as the garment is removed and re-worn during repeated treatment and/or diagnostic sessions.

The objectives are achieved by providing a brassiere having breast cups configured with inflatable bladders specifically positioned and configured to manipulate the breast tissue into a lifted treatment/analysis position whilst simultaneously displacing laterally sideways/outward and downward the untreated contra-lateral breast. In particular, the inventors provide a brassiere configured to lift the breast away from the chest wall and to stabilise the breast so as to increase treatment accuracy and reduce radiation dosage to high risk organs such as the heart and lung. The brassiere according to the subject invention is advantageous to be worn by women for the treatment of either the left or right breast whilst providing modesty during treatment delivery.

According to a first aspect of the present invention there is provided a brassiere comprising: at least one cover layer having a pre-formed shape defining a pair of breast cups, the cover layer at the region of each breast cup having an upper region for positioning at or towards the clavicle of a person, a medial inner region for positioning at or towards the sternum, a lower region for positioning at or towards the inframammary fold of a breast, a lateral region for positioning at or towards the serratus anterior and a central region for positioning generally at the nipple; an inflatable main bladder positioned respectively behind the cover layer at each cup, the main bladder extending along the lower region from the medial region to the lateral region of each cup; the main bladder having an inlet port to allow an inflation fluid to be introduced into the main bladder to lift the breast against gravity; a second breast movement component positioned respectively at each breast cup at the upper region and the medial inner region configured to move the breast laterally outward from the inner region in an orientation towards the lateral region; wherein the main bladder of a first cup of the pair of cups is configured to lift a first breast against gravity and second movement component of a second cup of the pair of cups is configured to move a second breast in the direction towards the lateral region and away from the first breast.

Advantageously, either the left or right breast cup main bladder may be inflated immediately prior to radiotherapy treatment according to specific desired levels to optimise breast positioning within and outside the radiotherapy beam. The second breast movement component is advantageous to press the non-treated (contra-lateral) breast out of the radiotherapy beam so as to reduce radiation exposure.

The inflatable main bladders are configured by their shape profile (in particular the pre-formed shaped of each cup) and relative positioning at the bra so as to be complementary to the curvature of breast tissue and to provide a universal garment suitable for a range of patient and breast sizes and shapes. In particular, the main bladders extend and protrude beyond the 'footprint' of the breast tissue (and in particular beyond the inframammary fold) to ensure a smooth and even breast lift and shaping of the breast tissue from the lower chest to the breast once a bladder is inflated. Additionally, the main bladders are shaped to conform to the contours of the brassiere cup and are co-located within the structure of the garment so as to be formed integrally. Optionally, each bladder is formed from an elastic or semi-elastic material such as a nitrile or polyurethane material to provide a fluid tight chamber configured to receive the inflation fluid. Preferably, each main bladder may be capable of elongating, stretching and generally changing shape from an uninflated to inflated shape profile in order to adjust the breast to a desired position and shape suitable for treatment.

Optionally, each main bladder may be connectable to a pump via a one way valve. The bladders may be inflated during or immediately before radiotherapy treatment to a level predetermined to achieve optimum breast tissue positioning via computerised tomography (CT) planning undertaken as part of an initial calibration and setting stage of the radiotherapy. Each main bladder is capable of being filled completely or partially with an inflation fluid (typically a gas and preferably air) resulting in the lifting and partial centralising of breast tissue.

Preferably, each port of the main bladder is positioned at or towards the lateral and lower regions to encourage fluid to fill each bladder from the lateral and lower regions respectively towards the medial inner region. Preferably, each inlet port of the main bladders comprises a respective valve that is operable to open and close independently.

Preferably, the main bladders are positioned at each breast cup to encompass the inframammary fold of each breast. In particular, the main bladders are positioned to extend below each breast cup and in particular below the inframammary fold of the breast so as to ensure the breast is lifted appropriately and to avoid tissue wrinkling, creasing or folding which would otherwise be detrimental to treatment and potentially damaging to surrounding skin, tissue and organs. Optionally, the main bladders extend below the breast cups such that between 1 to 10% of a volume of each main bladder extends below each breast cups. The brassiere comprising breast cups is advantageous in that the cups facilitate the transition of the breast tissue from the region of the upper abdomen and through the inframammary fold region to prevent indentation, rippling or other undesirable perturbation of the tissue with inflation of the respective bladder.

Preferably, the cover layer is a four-piece structure having a left and right hand side part with each part having an inner and an outer layer. Preferably, each inner and outer layer (of each right and left side) is formed from a single fabric sheet to reduce joining, stitching, seam and fabrication details. Reduced fabrication detail reduces incidence of pressure lines and joint loadings on breast tissues and garment-to-tissue rubbing. Reduced fabrication details (seams and part joint lines) further reduces negative effects on the breast outline that may be detrimental to optimise distribution of the radiation dose within the breast. Preferably, the material of the cover layer is flexible but of sufficient rigidity. Such a configuration is advantageous to create and maintain a curved cup shape from a heat pressing process in which the initial sheet-like material is deformed by hot tool pressing. The cover layer is preferably made from a compliant material such that the cups are capable of deforming enough to both encapsulate and change shape to conform to the breast volume whilst supporting and shaping the breast. Preferably, each cup extends upwards towards and over the upper breast; sideways towards the underarm area (wing) and downwards beyond the inframammary fold.

Preferably, the cover layer extends below the lower region of each respective cup and the inframammary fold and comprises a lower support region being non-profiled relative to the cups to extend laterally outward from respective sides of the xiphisternum. The cover layer extends from the primary region of the breast and beyond the inframammary fold towards or at a region of the upper abdomen. In particular, the lower support region may extend below the cups by a distance in the range 1 mm to 100 mm or more preferably by a distance of at least 10 mm, 20 mm, 30 mm, 40 mm or preferably in a range 40 to 100 mm, 40 to 80 mm, 40 to 70 mm and more preferably 50 to 70 mm.

Preferably, the lower support region comprises an aperture positioned centrally between and below the pair of cups so as to not cover the xiphisternum. Such an arrangement is advantageous to allow a healthcare practitioner (therapeutic radiographer/radiation therapist) to visualise and physically confirm the desired positioning of the garment in relation to the xiphoid/xiphisternal joint. Optionally, the brassiere may comprise laser registration markers of an adequate size to further assist in correct positioning of the brassiere and patient immediately prior to therapy or diagnosis. For example, such laser registration markers may comprise an marker placed at various regions on the brassiere including in particular the central region (between the breast cups, at the breast cups, at a lateral side region laterally beyond the breast cups, and at the lower support region of the cover layer).

Preferably, each secondary breast movement component comprises a secondary bladder having an inlet port to allow an inflation fluid to be introduced into each respective secondary bladder. Preferably, each secondary bladder comprises the same material composition and inlet port arrangement as described with reference to the main bladder. In particular and preferably each secondary bladder comprises a respective valve that is operable to open and close independently. Preferably, each valve of the main and secondary bladders is operable to open and close independently of one another.

Optionally, the secondary breast movement component may comprise strapping, a cover, pad or layer material removably attachable at the cover layer. Optionally, the secondary breast movement component comprises straps having hook or loop fastenings engageable with corresponding loop or hook fastenings provided at the cover layer. Accordingly, the straps or pads may be adhered onto the outside surface region of the cover layer at the upper medial inner region of the cover layer. Optionally, the majority of the cover layer at each breast cup may comprise hook and loop fastenings or may comprise a material attached to the cover layer comprising hook and loop fastenings to cooperate with respective straps, pads or additional layers of material to provide the compression and laterally outward manipulation of the breast tissue. Optionally, these straps may comprise a length in a range 50 to 150 mm and a width in a range 10 to 150 mm.

Preferably, each inlet port of each secondary bladder is positioned respectively at the medial inner region to encourage fluid to flow into each secondary bladder from the medial inner region laterally outwardly towards the lateral region.

Optionally, an upper generally central region of each main bladder is positioned generally at a central region of each breast cup at the region of the nipple. Optionally, lateral regions of each main bladder are positioned uppermost relative to respective medial inner regions of each main bladder.

Preferably, the cover layer is divided at a position between the pair of cups and comprises a separable seam having respective fastenings to allow the brassiere to be fastened in position over the breast and to be removed via the seam. Preferably, the frontal separable seam comprises hook and eye fasteners extending along the length of the seam located at a central region of the brassiere between the breast cups that may be referred to as a 'gore'. The separable seam provides a front opening brassiere configuration to facilitate daily placement and removal of the garment. Such an arrangement also enables patients experiencing reduced mobility and movement to fit the brassiere without or with limited assistance. Preferably, the hook and eye fasteners are formed from a material such as a plastic that does not interfere with the analysis (such as imaging) or treatment of the breast via radiation based techniques including for example X-ray imaging and radiation beams.

Preferably, the brassiere comprises shoulder straps to allow the brassiere to extend over the clavicle and around a patient's back. The brassiere also further comprises 'wing' sections and/or straps to extend laterally around the torso of a patient from the serratus anterior and around the patient's back. Preferably, the straps and wings sections are formed from an elastic material and comprise fastenings (e.g. hook and eye, poppers and the like) suitable for securing the brassiere in position during an initial fitting session. As before, such components of the brassiere are formed from non-metal materials to avoid interference with imaging or radiation beams. The present garment is intended such that the shoulder straps and wing sections, once coupled together via their respective fastenings, are not released or detached with the brassiere being fitted and removed subsequently by a patient via the frontal seam.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
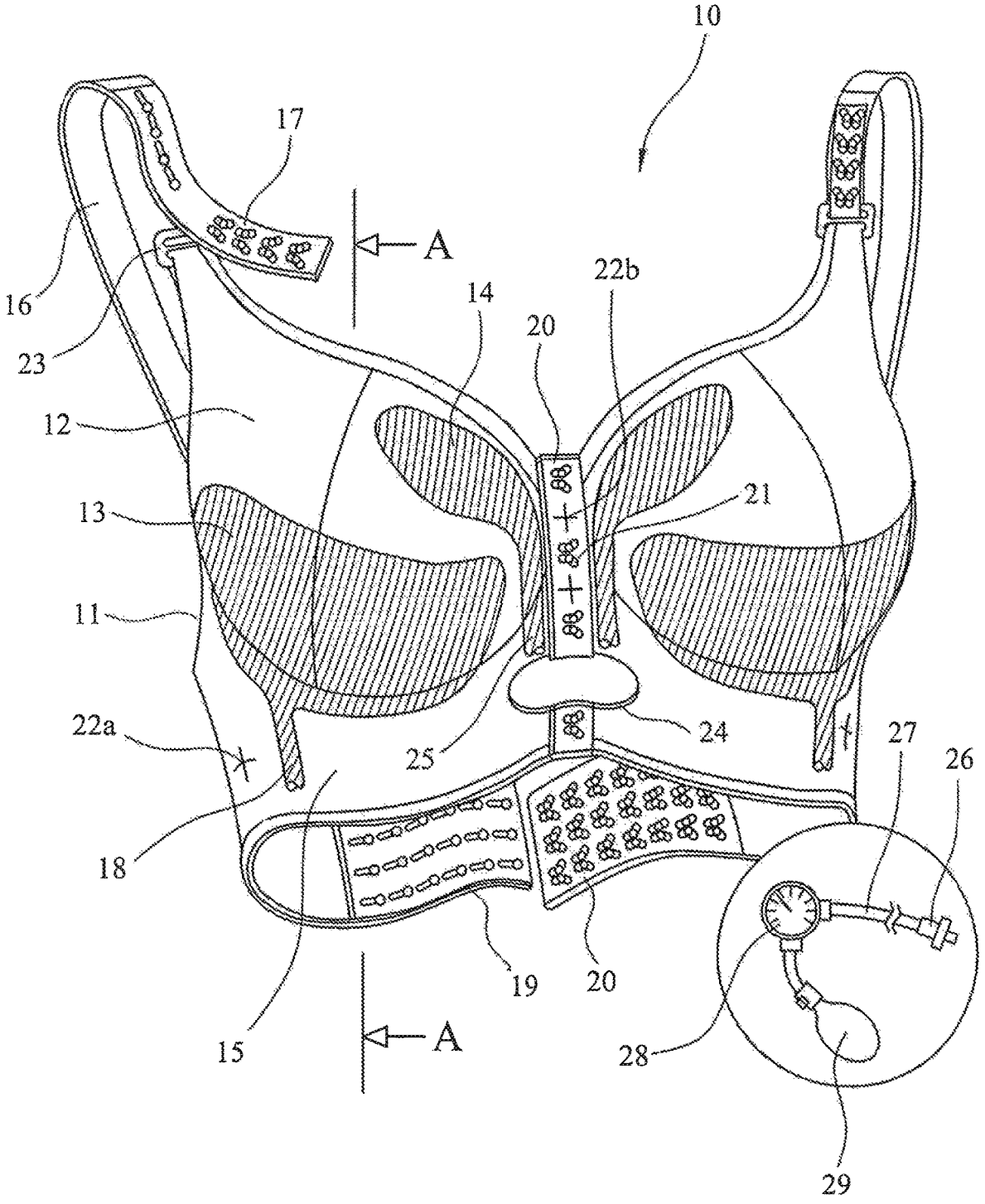
FIG. 1 is a front perspective view of a brassiere having a pair of breast cups configured with inflatable bladders according to a specific implementation of the present invention.
Figure 2:
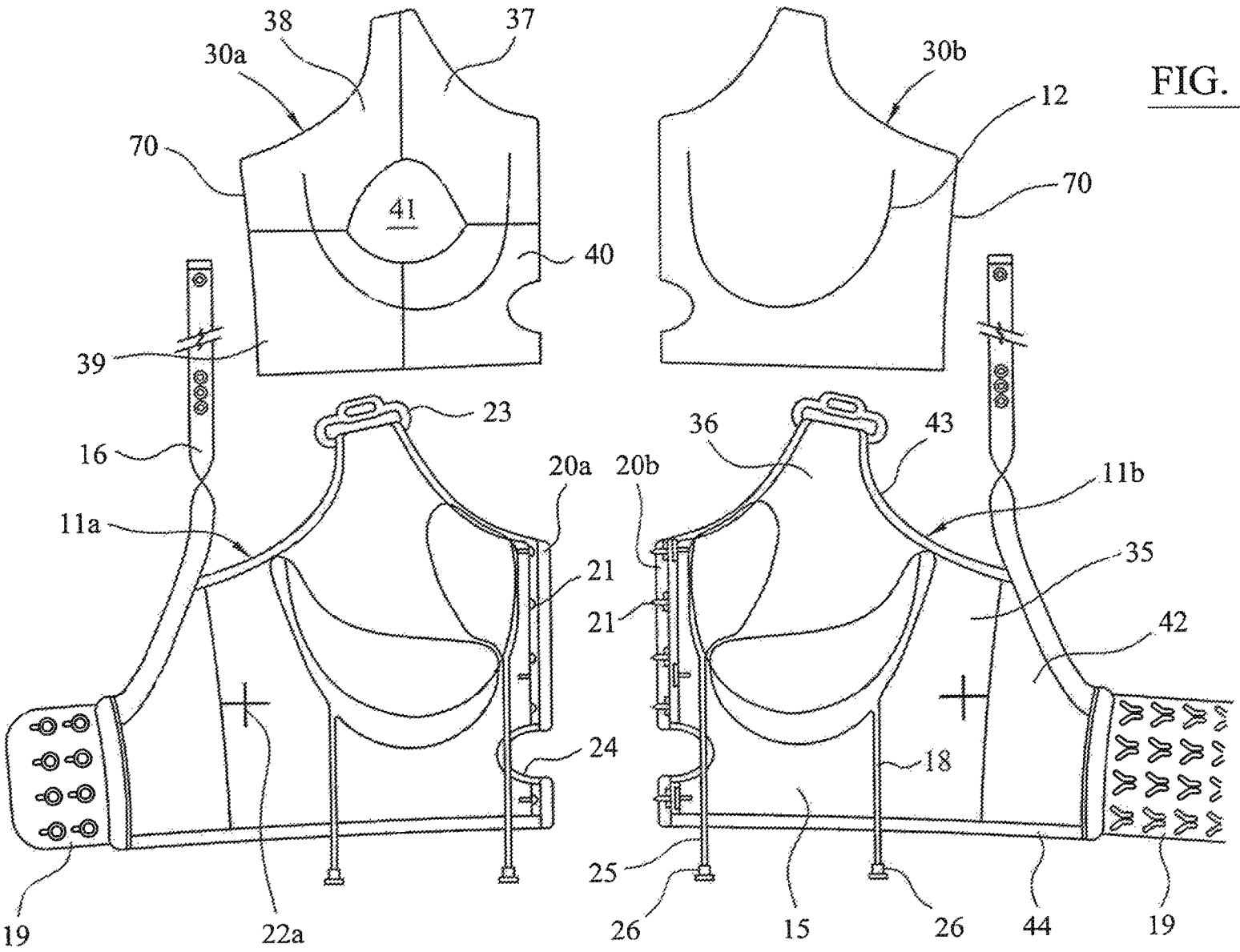
FIG. 2 is a partial exploded view of the brassiere of FIG. 1.

Referring to FIGS. 1 and 2, a brassiere (bra) 10 comprises a pair of breast cups indicated generally by reference 12. Each breast cup is defined by a cover material or layer 11 formed from a fabric having a shape memory characteristic. In particular, the fabric material of cover layer 11 is formed as a sheet that via a process of thermal pressing is capable of being deformed to form the two curved breast cups 12 which hold the respective shape configurations by virtue of such thermal pressing. Cover layer 11 is formed from a material having a sufficient stiffness so as to provide structural support to the breast and prevent undesirable breast movement once the bra 10 is secured in position at a patient.

Referring to FIGS. 1 and 2, cover layer 11 according to the specific implementation is formed from two separate single pieces 11*a*, 11*b* corresponding to a left and right breast cup 12. Each cover layer piece 11*a*, 11*b* (and each corresponding breast cup 12) may be considered to be divided into different regions relative to the anatomy of a patient and the general position of the cups 12 as they support each breast.

Figure 3:
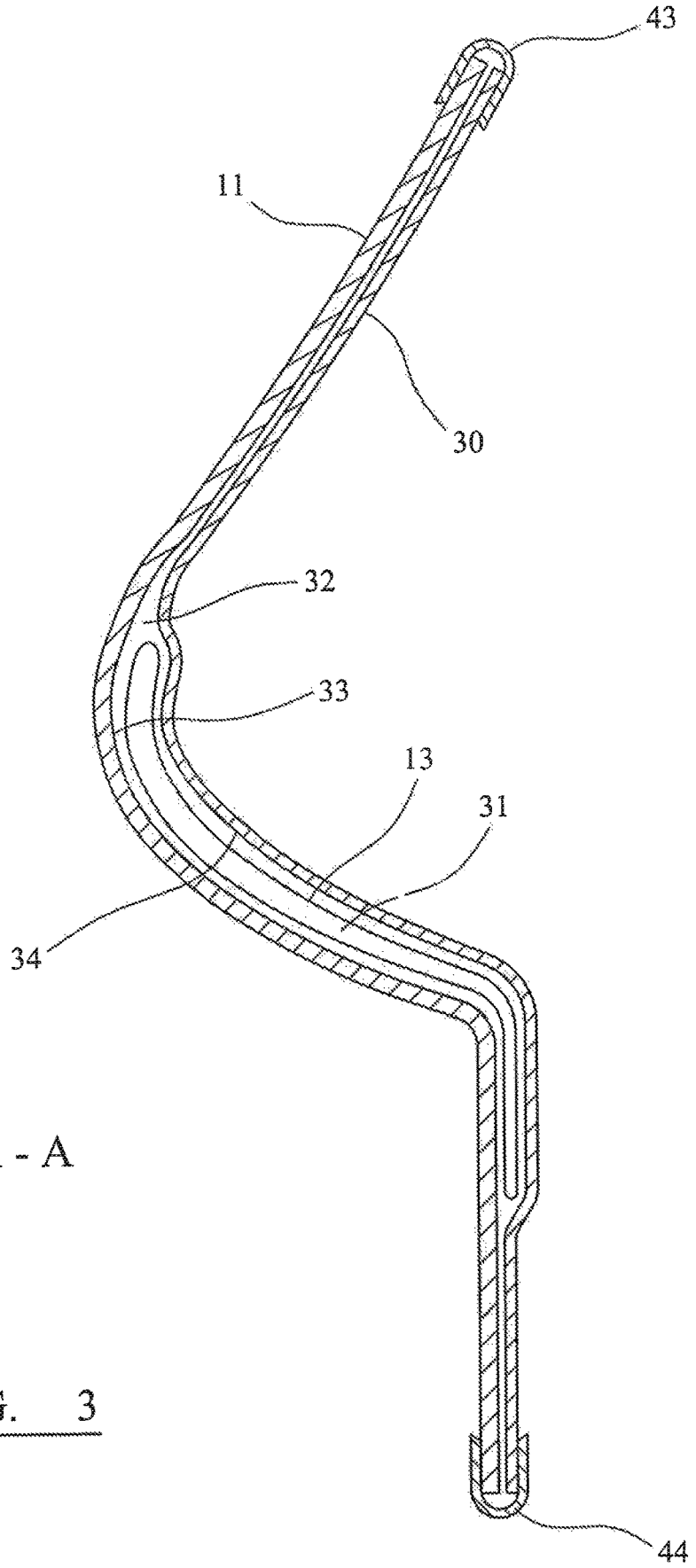
FIG. 3 is a cross sectional view through A-A of FIG. 1.

Referring specifically to FIGS. 2 and 3, the bra 10 at the region of each breast cup 12 is formed as a multilayer structure in which the cover layer 11 represents an outward orientated part of the bra 10. The bra 10 also comprises an inward facing comfort layer 30 extending immediately behind cover layer 11. Comfort layer 30 is formed from a softer, more deformable material than the shape memory cover layer 11 such that comfort layer 30 is configured to conform to the pre-formed curved shape of each cover layer piece 11*a*, 11*b*. Each layer 30 (of the left and right hand side sections) is formed from a single piece material to provide a simplified construction which is advantageous to reduce the risk of breast tissue wrinkling or creasing resulting from seams, sticking etc., as the bra 10 is actuated to manipulate the tissue in use. For illustrative convenience, and with reference to the left and right breasts comfort layers 30*a*, 30*b*, each comfort layer piece 30*a*, 30*b* and accordingly each cover layer piece 11*a*, 11*b* (cup 12) comprises generally a lower region 38, 40 and an upper region 37, 38. Each cup cover layer piece 11*a*, 11*b* is formed from a single fabric sheet to reduce joining, stitching, seam and fabrication details that may otherwise create pressure lines and point loadings on breast tissue. Such single piece components 11*a*, 11*b* reduce the opportunity for pressure sores and garment to tissue rubbing and accordingly increase patient comfort. Reduced fabrication details (seams and part join lines) further reduce negative effects on breast outline that may affect the ability to produce an acceptable radiation dose distribution within the breast Each of these upper and lower regions may be divided further into a respective medial inner region 37, 40 and a lateral region 38, 39. Accordingly, each cover layer piece 11*a*, 11*b* (cup 12) may be divided into an upper medial inner region 37; a lower medial inner region 40; a lateral lower region 39 and a lateral upper region 38. Each region 37 to 40 extends respectively from a perimeter of each cover layer piece 11*a*, 11*b* to a central innermost region 41 that corresponds generally to a central position of each breast cup 12 to be positioned over a breast nipple. The upper medial inner region 37 is configured for positioning towards an upper part of the sternum 66 and the lower medial inner region 40 is configured for positioning towards a lower region of sternum 66 and in particular the xiphisternum 61. Lateral lower region 39 is configured for positioning at or towards the serratus anterior 62 whilst upper lateral region 38 is configured for positioning towards the pectoralis minor. Upper lateral region 38 is provided to extend in close fitting contact to the junction of the torso and arm union (underarm) to cover and encapsulate tissue at a 'breast tail' (breast tissue in the area of the underarm) and to provide a patient 'snug-fit' that in turn reduces or eliminates the occurrence of the breast tissue bulging over from the outermost lateral edge of the garment 10.

Additionally, the upper regions 37 and 38 taper upwardly to form a base part 36 of shoulder straps 16 to extend over the shoulders and around the back of a patient. In particular strap base part 36 is configured for positioning over the clavicle 63. Each regions 37 to 40 of cover layer pieces 11*a*, 11*b* are curved to collectively define the each breast cups 12 that extends over all regions all regions 37 to 40 and central region 41. A lowermost section of lower regions 39, 40 is non-profiled (relative to the majority of the curved breast cup 12) and is formed as a generally flat band that extends from the lower medial inner region (at the xiphisternum 61) to the lower lateral region (at the serratus anterior 62). This band region is referred to generally as reference 15 and comprises a width (in a direction perpendicular to a lateral direction between the xiphisternum 61 and the serratus anterior 62), that is in a range 40 to 80 mm so as to extend a sufficient distance below the inframammary fold indicated generally by reference 45 referring to FIG. 5. Such a configuration is advantageous to ensure the breast tissue is encapsulated fully and to securely position and mount the bra 10 at a patient. Accordingly, the bra 10 is configured to surround a reasonable portion of a person's upper abdomen [*HR2*] indicated generally by reference 60 and to extend onto the upper region of the rectus abdominis. The cover layer at each respective lower medial inner region 40 comprises a notch such that when the pieces 11*a*, 11*b* are coupled together to form bra 10, an opening or aperture 24 is defined to expose the xiphisternum. Such an arrangement is advantageous to allow medical staff to identify the correct positioning of the bra 10 at a patient by reference to the xiphisternum.

Each strap base part 36 mounts a corresponding clip or buckle 23 to receive respectively each strap 16 being conventional to the majority of bras, with each strap 16 comprising suitable adjustable fastenings 17. Each cover layer piece 11*a*, 11*b* comprises a lateral end edge 70. Bra 10 further comprises a pair of wings indicated generally by reference 42 that project laterally outward from each edge 70 with each wing 42 being formed from a material different to cover layer 11. Each wing 19 is terminated at its laterally outermost end by a respective elasticated strap 19 formed from a material different to wings 19 and cover layer 11, with each strap 19 configured to extend around the back of a person according to conventional bra configurations. According to the specific implementation, an elasticity of each of the wing 42 and each strap 19 is greater than that of each cover layer piece 11*a*, 11*b* such that in combination with straps 16, straps 19 are capable of securing the bra 10 in position at a person. Each strap 19 accordingly comprises releasable attachments 20 according to conventional configurations. Advantageously, the present bra 10 comprises a third releasable fastening in the form of a central seam indicated generally by reference 20 that extends in the upward and downward direction between the breast cups 12 so as to couple each cover layer piece 11*a*, 11*b*. Seam 20 comprises a first part 20*a* and a second part 20*b*, with each part comprising respective fastenings 21 to allow each seam part 20*a*, 20*b* to be releasably coupled together so as to provide a front opening bra arrangement. Accordingly, bra 10 is configured to be 'fitted' to a person via an initial fitting and calibration stage, supervised by medical staff, to ensure bra 10 is appropriately adjusted such that the breasts are fully encapsulated within each breast cup 12 to the desired degree and in particular cover layer pieces 11*a*, 11*b* encapsulate the inframammary fold region 45 as desired. A person may then conveniently mount and remove the bra 10 via the releasable central seam 20. Further positioning and alignment verification is achieved by bra 10 comprising laser markers 22*a* located within lower lateral region 35 of each cover piece 11*a*, 11*b* and respective laser markers 22*b* provided at seam 20. Optionally, each cover layer piece 11*a*, 11*b* comprises a material that may be marked by a fabric pen or similar during an initial set-up or planning stage with such custom marking being identifiable during subsequent treatment/diagnostic sessions.

Each left and right hand set of layers 11 and 30 are secured in position by an upper seam 43 and a lower seam 44 extending respectively above and below each breast from the medial inner to the lateral outer regions. A pocket region 32 is defined between respective inward facing surfaces 33 and 34 of the outer and inner layers 11 and 30. A main inflatable bladder 13 having an internal chamber 31 is housed within each left hand and right hand pocket 32. Additionally, each pocket 32 accommodates a secondary bladder 14 (not shown in FIG. 3) such that each breast cup comprises a primary main bladder 13 and a secondary bladder 14. Each bladder 13, 14 may be secured in position within each pocket 32 by stitching or spot welds (not shown) provided respectively between each bladder 13, 14 and layer 11 and/or layer 30.

Each bladder 13, 14 is formed from an elastic stretchable material such as a polyurethane or nitrile material and is capable of elongating and stretching in response to an inflation fluid being introduced respectively into each bladder 13, 14 as desired. Each main bladder 13 is positioned within each pocket 32 so as to extend from the medial inner region to the lateral region extending over predominantly lower regions 40, 39 and central region 41. In particular, each main bladder 13 may be regarded as extending over a lower region of each breast cup 12 so as to extend from the region of the breast nipple to below the inframammary fold and onto the region of strap or band 15 extending laterally to each side of the xiphisternum.

Figure 4:
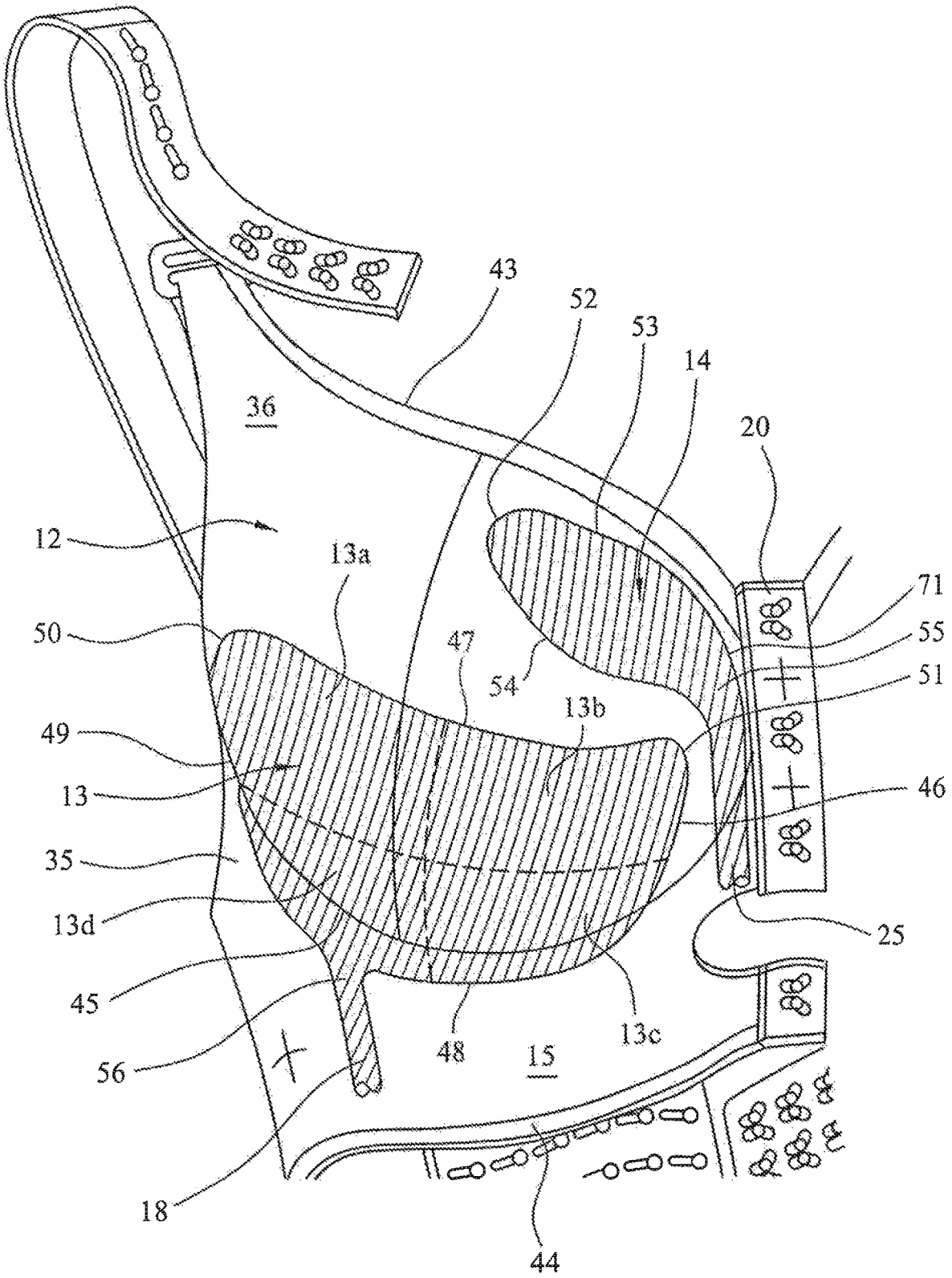
FIG. 4 is a magnified perspective view of one of the breast cups of FIG. 1.

Referring to FIG. 4, each main bladder 13 may be divided for illustrative purposes only into four zones including an upper medial inner zone 13*b*; a lower medial inner zone 13*c*; a lower lateral zone 13*d* and an upper lateral zone 13*a*. Each bladder 13 extends substantially the full lateral width of breast cup 12 and comprises an first innermost end 46 located a short distance laterally to the side of central seam 20 at the region of the sternum 66 and a second lateral outer end 49 positioned at the lateral outermost side of the breast cup 12 at the region of the serratus anterior. Additionally, a lower region 48 (or curved edge region) of each bladder 13 extends below the inframammary fold 45 and in particular below the curvature of each cup 12 such that the bladder lower region 48 is positioned at the non-profiled band 15. Lower region 48 (below breast cup 12) extends over a distance in the range 50 to 95% of the full width (in the lateral direction) of each breast cup 12 so as to encapsulate substantially all of the inframammary fold 45. Accordingly, each main bladder 14 is positioned generally to extend across the full width of each breast cup 12 (at a lower region of each cup 12) so as to be capable of lifting the entire breast tissue when each bladder 13 is inflated. Encapsulating the inframammary fold 45 is advantageous to avoid trapping, rippling, wrinkling or otherwise distorting the breast tissue (during bladder inflation) which will be disadvantageous for therapy and diagnosis specifically with regard to radiation exposure. Additionally, to achieve the desired lifting and centralising of the breast tissue, and to further reduce the likelihood of undesirable tissue rippling or trapping, an uppermost part 50 of the second lateral outer end 49 of bladder 13 is positioned above (or higher than) a corresponding uppermost part 51 of the first innermost end 46. Accordingly, each bladder 13 may be perceived to be inclined to taper downwardly from its lateral outermost end 49 to its innermost end 46 such that an upper region (or curved upper edge 47) of each bladder 13 slopes downwardly from the pectoralis minor to the sternum 66.

Each secondary bladder 14 is positioned generally at an upper medial inner region of each breast cup 12 (and each cover layer piece 11*a*, 11*b*) so as to project upwardly and laterally outward from the region of central seam 20 and the sternum 66. That is, each secondary bladder 14 is intended to extend over the upper inner region of each breast so as to provide a very different breast manipulation function to that of the primary bladders 13. Referring to FIG. 4, each secondary bladder 14 comprises an outermost lateral end 52 positioned within the medial inner region 37 of each cover layer piece 11*a*, 11*b* and a lateral inner end indicated generally by reference 71 positioned in close proximity to central seam 20 substantially at sternum 66. Each secondary bladder 14 also comprises an upper region 53 positioned immediately below upper seam 43 and a lower region 54 positioned immediately above central region 41. In particular, each bladder 14 extends almost exclusively within the upper medial inner region 37 of each cover piece 11*a*, 11*b* and is positioned generally above and to the medial inside of central region 41.

Each respective bladder 11, 14 comprises a respective inlet port in the form of an elongate tube formed as an extension of each bladder and preferably from the same elastic stretchable material. The inlet tubes 18 of the main bladder 13 are positioned at the lower lateral sides of each bladder 13 so as to extend from the region below the inframammary fold 45 (at the junction of the curved breast cup 12 and the non-profiled band 15). Each tube 18 extends within the same pocket 32 that accommodates the bladders 13 and 14. A small slit or opening (not shown) is provided within either of the layers 11, 30 from which an endmost part of each tube 80 projects. Each of the secondary bladders 14 comprises a corresponding fluid inlet tube 25 extending within each pocket 32. Each secondary inlet tube 25 is positioned at the respective lateral side of central seam 20 to extend from each secondary bladder 14 at its respective medial inner end 71. Each tube 18, 25 accordingly defines fluid inlets 56, 55 at each bladder 13, 14 respectively. The main bladder inlet 56 is positioned below inframammary fold 45 at the lower lateral region of each cover layer piece 11*a*, 11*b*. Additionally, the secondary bladder inlet 55 is positioned at the medial inner end 71 immediately laterally to the side of the central seam 20. A respective valve 26 is mounted at each end of each tube 18, 25. Each valve 26 is connectable to a suitable supply reservoir 29 (such as a pump, syringe, canister, or other fluid vessel) via a gauge 28 and hose 27 so as to allow each respective left and right hand main and secondary bladder 13, 14 to be inflated independently. That is, each of the four bladders 13, 14 may be inflated independently of one another by coupling to a single common pump 29 via valves 26.

Figure 5:
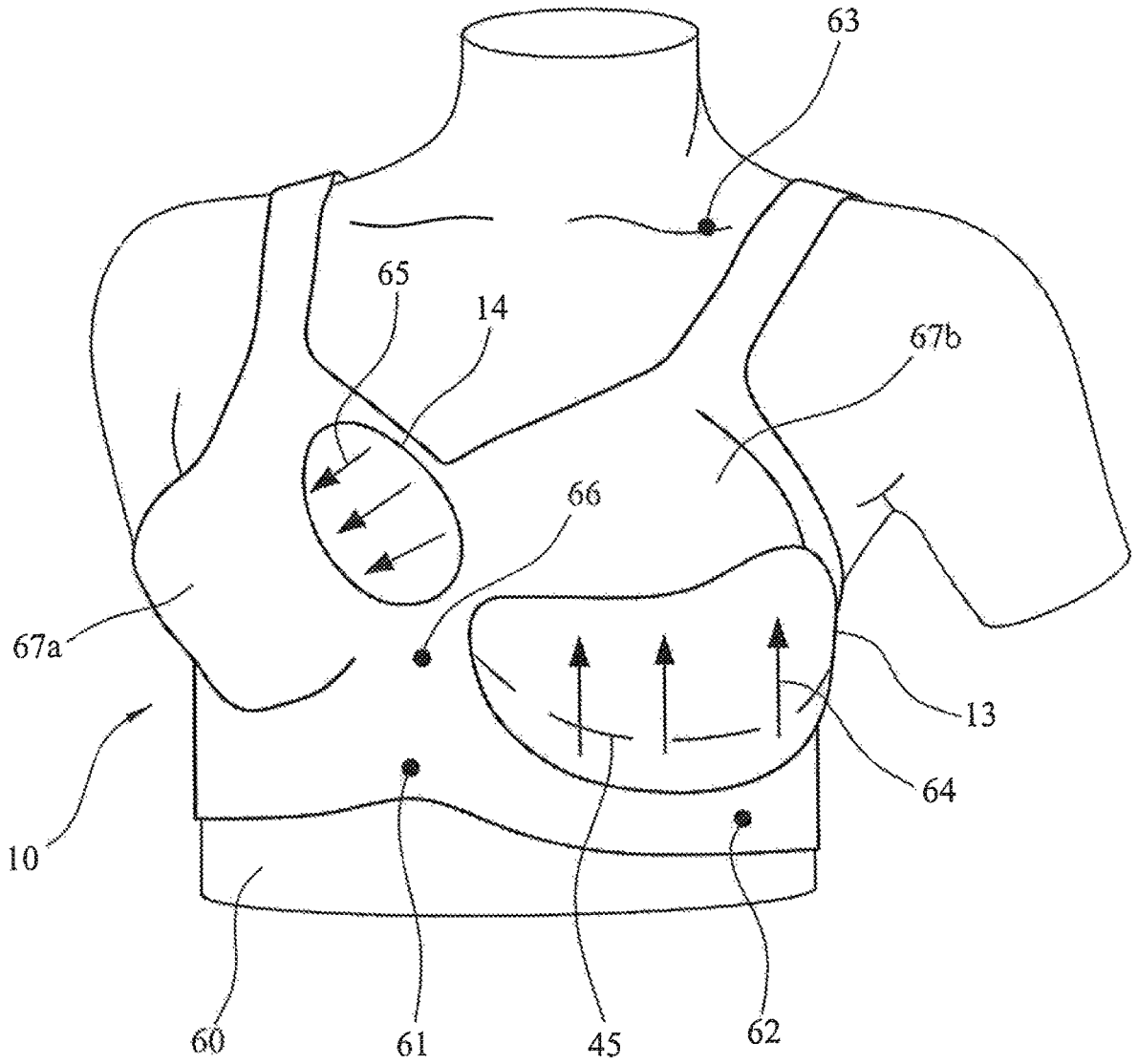
FIG. 5 illustrates schematically a brassiere of FIG. 1 worn in position by a patient.

Referring to FIG. 5, bra 10 via the respective bladders 13, 14 provides a medical garment configured for the asymmetric manipulation of the left and right hand breasts to suit the radiotherapy or diagnostic imaging of the appropriate breast. By providing both left and right hand main and secondary bladders 13, 14, bra 10 is symmetrically constructed to provide a universal garment within which selected bladders may be inflated to achieve appropriate lifting or compression (and lateral sideways deflection) of the relevant breast. Referring to FIG. 5, a patient requiring radiotherapy treatment of a left breast 67*b* would require inflation of the corresponding left bladder 13. Due to the relative position of fluid inlet 56 (located at the lateral and lower region of cover piece 11*b* at the main bladder zone 13*d*) the inflation fluid (air) is configured to flow upwardly (indicated by arrows 64) and towards the medial inner region so as to provide a lifting and centralising manipulation of the left breast 67*b*. To reduce radiation exposure to the contra-lateral right breast 67*a*, the right hand secondary bladder 14 is inflated via introduction of air at inlet 55. This provides a corresponding laterally outward compressive manipulation of the right breast 67*a* as indicated by arrows 65. That is, the tissue of breast 67*a* is forced and compressed laterally outward from an upper region of the sternum 66 (cup region 37) towards a lateral portion of the inframammary fold 45 (cup region 39). This action also increases the volume of breast tissue at and below the inframammary fold 45. Accordingly, the tissue of the contra-lateral breast 67*a* is moved away from the radiative treatment zone of breast 67*b*. For the purposes of clarity, to achieve the lifting and compression of the respective breasts 67*b* and 67*a*, (as shown in FIG. 5), the main bladder 13 at the right hand breast 67*a* and the secondary bladder 14 at left hand breast 67*b* are dormant (uninflated).

The invention claimed is:

1. A brassiere comprising:

at least one cover layer having a pre-formed shape; and a pair of breast cups including a first cup for receiving a first breast of a person and a second cup for receiving a second breast of the person, each breast cup having an upper region for positioning at or towards a clavicle of the person, a medial inner region for positioning at or towards a sternum of the person, a lower region for positioning at or towards an inframammary fold of the respective first or second breast, a lateral region for positioning at or towards a serratus anterior of the person, and a central region for positioning generally at a nipple of the respective first or second breast; each breast cup further including:

an inflatable main bladder positioned behind the at least one cover layer, the main bladder extending along the lower region from the medial inner region to the lateral region of the respective cup; the main bladder having an inlet port to allow an inflation fluid to be introduced into the main bladder to lift the respective first or second breast against gravity; and an inflatable secondary bladder positioned behind the at least one cover layer and extending continuously along the upper region and the medial inner region of the respective cup, wherein the secondary bladder is configured to move the respective first or second breast laterally outward from the medial inner region towards the lateral region; the secondary bladder having an inlet port to allow an inflation fluid to be introduced into the secondary bladder;

wherein the main bladder of the first cup is configured to lift the first breast against gravity, and the secondary bladder of the second cup is configured to move the second breast in a direction towards the lateral region of the second cup and away from the first breast.

2. The brassiere as claimed in claim 1 wherein each inlet port of the main bladders is positioned at or towards the lateral and lower regions of each respective cup to encourage fluid to fill each bladder from the lateral and lower regions towards the respective medial inner region.

3. The brassiere as claimed in claim 1 wherein each inlet port of the main bladders comprises a respective valve that is operable to open and close independently.

4. The brassiere as claimed in claim 1 wherein the main bladders are positioned and configured to encompass the inframammary fold of each breast.

5. The brassiere as claimed in claim 1 wherein each secondary bladder comprises a respective valve that is operable to open and close independently.

6. The brassiere as claimed in claim 5 wherein each valve of the main and secondary bladders is operable to open and close independently of one another.

7. The brassiere as claimed in claim 1 wherein each inlet port of each secondary bladder is positioned respectively at the medial inner region of each cup to encourage fluid to flow into each secondary bladder from the respective medial inner region laterally outwardly towards the respective lateral region.

8. The brassiere as claimed in claim 1 wherein the at least one cover layer comprises a single piece of material.

9. The brassiere as claimed in claim 1 wherein the at least one cover layer extends below the lower region of each respective cup and is configured to extend below the inframammary folds of the person, and wherein the at least one cover layer comprises a lower support region having a generally flat shape relative to the cups, the lower support region configured to extend laterally outward from respective sides of a xiphisternum of the person.

10. The brassiere as claimed in claim 9 wherein the lower support region extends below the cups by a distance of at least 40 mm.

11. The brassiere as claimed in claim 9 wherein the lower support region extends below the cups by a distance in a range of 40 to 80 mm.

12. The brassiere as claimed in claim 9 wherein the lower support region comprises an aperture positioned centrally between and below the pair of cups such that the aperture is configured not to cover the xiphisternum.

13. The brassiere as claimed in claim 1 wherein an upper generally central region of each main bladder is positioned generally at the central region of each breast cup.

14. The brassiere as claimed in claim 1 wherein lateral regions of each main bladder are positioned uppermost relative to respective medial inner regions of each main bladder.

15. The brassiere as claimed in claim 1 wherein the at least one cover layer is divided at a central position of the brassiere at an area between the pair of cups, the at least one cover layer comprising a separable seam having respective fastenings to allow the brassiere to be fastened in position over the first and second breasts via the separable seam and to be removed via the separable seam.

* * * * *